US005935307A

United States Patent [19]

Parks

[11] Patent Number: 5,935,307

[45] Date of Patent: Aug. 10, 1999

[54] COMPOSITIONS AND METHODS FOR INCORPORATING ALLOYING COMPOUNDS INTO METAL SUBSTRATES

[76] Inventor: Katherine D. Parks, 2727 Cook's View, Lynchburg, Tenn. 37352

[21] Appl. No.: 08/833,827

[22] Filed: Apr. 10, 1997

[51] Int. Cl.[6] ..... C09D 5/00; C23C 22/02

[52] U.S. Cl. ..... 106/14.44; 106/14.05; 106/14.26; 106/14.33; 106/287.17; 106/483; 106/486; 106/487; 106/811; 148/248

[58] Field of Search ..... 106/14.05, 14.26, 106/14.44, 623, 632, 634, 635, 482, 483, 486, 487, 14.33, 811, 287.17; 148/248

[56] References Cited

U.S. PATENT DOCUMENTS

| | | | |
|---|---|---|---|
| 5,356,842 | 10/1994 | Yamakawa et al. | 501/87 |
| 5,384,306 | 1/1995 | Konig et al. | 501/152 |
| 5,389,591 | 2/1995 | Guigonis et al. | 501/133 |
| 5,470,806 | 11/1995 | Krstic et al. | 501/90 |
| 5,503,703 | 4/1996 | Dahotre et al. | 156/272.8 |
| 5,545,687 | 8/1996 | Burns et al. | 524/701 |
| 5,593,930 | 1/1997 | Sato | 501/141 |

OTHER PUBLICATIONS

Chemical Abstract No. 109:26677, abstract of Japanese Patent Specification No. 63–050382, Mar. 1988.

WPIDS Abstract No. 96–111434, abstract of Japanese Patent Specification No. 08–011260, Jan. 1996.

WPIDS Abstract No. 97–203694, abstract of Chinese Patent Specification No. 1096776, Dec. 1994.

*Primary Examiner*—Anthony Green

*Attorney, Agent, or Firm*—Banner & Witcoff, Ltd.

[57] ABSTRACT

Compositions and methods for the introduction of alloying compounds into a metal substrate using a laser energy source is disclosed. The compositions comprise a viscous fluid mixture of a powdered silicate mineral composite, a powdered metallic or semi-metallic compound and a water insoluble or slightly water soluble liquid component capable of supporting a dispersion of the powdered silicate mineral composite and the powdered metallic or semi-metallic compound therein. The composition may be sprayed in bulk onto large surface areas of a metal substrate in need of repair prior to laser irradiation.

8 Claims, 1 Drawing Sheet

COMPOSITIONS AND METHODS FOR INCORPORATING ALLOYING COMPOUNDS INTO METAL SUBSTRATES

BACKGROUND OF THE INVENTION

1. Field of the Invention

Embodiments of the present invention relate in general to compositions and methods that are useful for incorporating certain alloying compounds into metal substrates. More particularly, embodiments of the present invention relate to fluid compositions comprising certain alloying compounds which may be sprayed onto metal substrates and then heated, for example by a laser, to temperatures sufficient to create a molten mixture and to disperse the alloying compound into the metal substrate.

2. Description of Related Art

Compositions do exist for bonding and/or cladding the surface of metal substrates with transition elements by using high intensity lasers. The interface between the cladding and the surface of the metal substrate is clearly defined with no substantial intermixing between the two sections. These compositions or the methods by which they are applied do not alter the chemical or physical composition of the metal substrate itself to improve characteristics.

Such compositions are also unfortunately generally in the form of dry metal powders and their application to metal substrates is often difficult and wasteful of the dry powder. Also, the application of the dry powder directly to the surface of the metal substrate involves several laborious steps to pre-treat the metal substrate prior to application of the metal powder to ensure that it will adhere to the metal substrate. In addition, given the difficulties in working with dry powders, dry powder deposition techniques are usually limited to applications involving small surface areas.

Accordingly, there is a need in the art to provide compositions and methods for incorporating alloying elements into metal substrates and also in a manner which overcome the drawbacks of existing compositions and methods of cladding metal substrates, while providing for economical and easy application.

BRIEF SUMMARY OF THE INVENTION

Embodiments of the present invention are directed to compositions and methods which are useful for incorporating alloying compounds into metal substrates to either produce altered metal substrates having improved physical or chemical characteristics or to repair damaged metal substrates. Compositions according to the present invention include a mixture of one or more silicate minerals in powdered form, one or more metallic or semi-metallic compounds in powdered form and a liquid medium capable of forming a dispersion of the powdered components. The resulting mixture has the consistency of a gel or viscous fluid which may then be applied to the surface of a metal substrate in much the same manner as a paint to achieve a substantially smooth and uniform layer of the dispersed components. This unexpected and important aspect of the present invention allows the compositions to be advantageously used in applications on an industrial scale as will be described below.

According to certain methods of the present invention, the composition may advantageously be applied either manually or by use of commercially available sprayers to coat the surface of a metal substrate, regardless of the surface area size or condition of the metal substrate, given the viscous fluid nature of the composition. The coating on the surface of the metal substrate is then heated in a manner sufficient to evaporate or otherwise remove the liquid component to leave a substantially uniform and hardened layer of the mixture of silicate minerals and metallic or semimetallic compounds adhered to the surface of the metal substrate. The metal substrate coated with the silicate minerals and metallic or semi-metallic compounds is then exposed to laser radiation of sufficient energy and for a sufficient period of time to effect a melting of both the coating and a portion of the metal substrate termed a "weld-melt" and to intermix or otherwise disperse a portion of the coating components within and throughout the molten portion of the metal substrate thereby altering the physical and/or chemical characteristics of the metal substrate. This process shall be termed "weld-mixing" for the purposes of describing the present invention.

In certain preferred embodiments of the present invention, the compositions and methods disclosed herein may be advantageously prepared and employed on a large scale to alter the composition of existing metal structures to improve physical characteristics such as strength, hardness, impact resistance, corrosion resistance, electrical conductivity, thermal stability, heat capacity and the like or to repair metal substrates which have been damaged by stress fractures, pitting, oxidation or other corrosion-induced damage. Certain advantageous applications of the compositions and methods of the present invention include the refurbishing of large metal surface areas in need of repair due to the thermally-sensitized corrosion, intergranular pitting and fatigue cracking of metallic materials which are unsuited to repair by using small scale dry powder deposition techniques. Specific examples include repair of (1) stress fractured inside walls of nuclear reactors, (2) aerospace fatigue cracking of turbine combustor parts, (3) corrosion of ocean vessels and metal structures in continuous contact with sea water, (4) corrosion of cooling loops inside commercial boilers, (5) fatigue and corrosion associated with automotive parts, and (6) aging weld-joints of commercial and residential structures which have been corroded due to oxidation of filler material.

Certain preferred embodiments of the present invention are further advantageous in that they provide compositions and methods for incorporating alloying compounds into metal substrates which are more economical, effective and easy to practice as compared with existing dry powder techniques. Certain additional embodiments of the present invention provide for novel alloy compounds having increased amounts of transition metal elements beyond amounts normally found in metal substrates.

One object of the present invention, therefore, is to provide novel compositions which are useful in incorporating alloying compounds into metal substrates. Another object of the present invention is to provide novel compositions which may be easily and economically applied in bulk to large scale metal surfaces which may benefit from the incorporation of alloying compounds. Another object of the present invention is to provide novel compositions which can be easily and economically prepared and coated onto the surface of a metal substrate. A further object of the present invention is to provide methods of incorporating alloying elements into the surface of a metal substrate both on small and large scales. A still further object of the present invention is to improve the physical and chemical properties of a metal substrate using a method which incorporates alloying elements into the metal substrate while avoiding the significant economical and practical application drawbacks of existing dry-powder deposition methods.

Other objects, features and advantages of certain embodiments of the present invention will become more fully apparent from the following description taken in conjunction with the accompanying drawing and claims.

BRIEF DESCRIPTION OF THE DRAWINGS

In the course of the detailed description of certain preferred embodiments to follow, reference will be made to the attached drawing, in which.

DETAILED DESCRIPTION OF CERTAIN PREFERRED EMBODIMENTS

Figure 1:
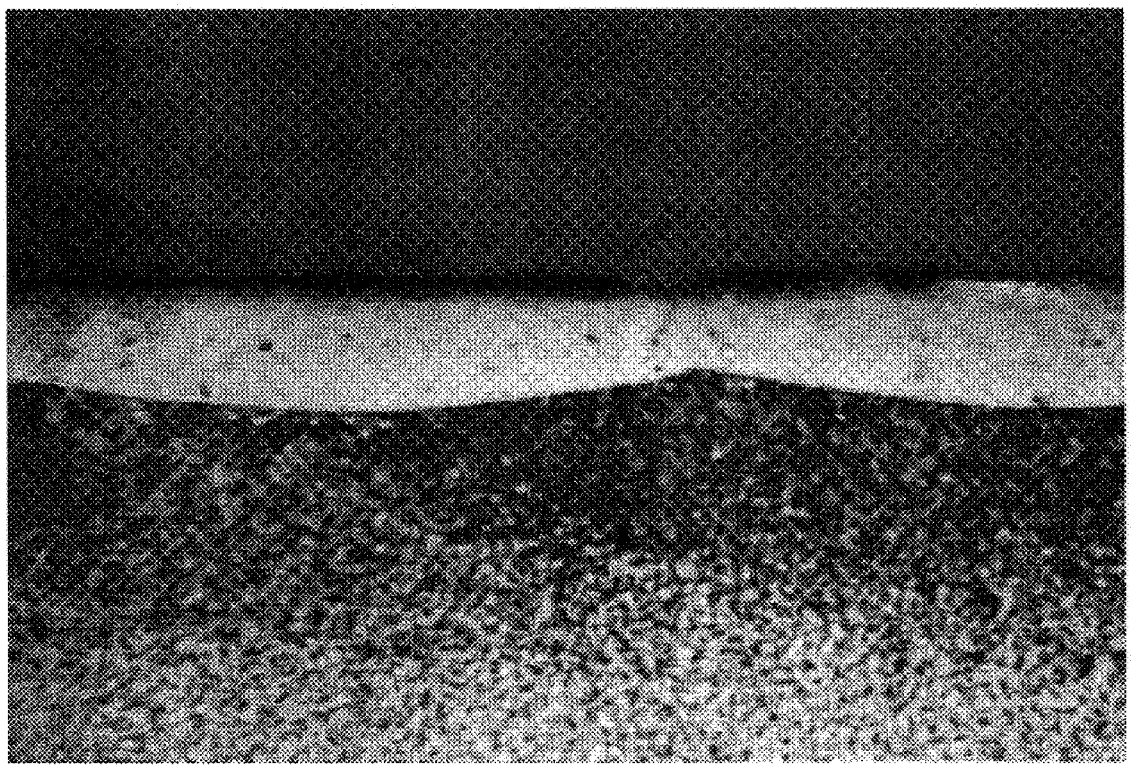
FIG. 1 is a photograph showing in cross section a metal substrate with alloying compounds dispersed within and through the top surface of the metal substrate, as indicated by the lighter shaded area.

The principles of the present invention may be applied with particular advantage to obtain compositions and methods for incorporating alloying compounds into metal substrates. The compositions of the present invention include as components one or more silicate or alumino-silicate mineral composites, one or more metallic or semi-metallic compounds and a liquid component. The components are mixed together in amounts sufficient to form a dispersion having the consistency of a gel or other highly viscous fluid, such as is observed with many paints. Other additive materials, for example, high temperature or other noncombustible, non-heat conducting and chemically resistant fibers such as asbestos or other asbestos-like insulating materials can also be added to the composition to impart desirable characteristics to the composition for use in certain applications. It is to be understood that all percentages used to designate weight percent of components of the compositions of the present invention is exclusive of these other materials.

The viscous fluid may then be applied to the surface of a metal substrate, dried to remove the liquid component and then irradiated with a high energy source, such as a laser, capable of liquefying or melting both the composition and the surface of the metal substrate so as to allow the molten composition and the metal substrate to intermix and disperse in a manner such that the silicate mineral composite and the metallic or semi-metallic compound becomes dispersed throughout the molten portion of the metal substrate and vice versa in either a heterogenous or homogenous manner, a process termed "weld-mixing". After irradiation, the metal substrate is allowed to cool thereby providing a metal substrate which has been permanently transformed chemically and physically to produce a new and distinct alloy comprising the silicate mineral composite, the metallic or semi-metallic compound and the metal substrate.

Preferably, a laser source is employed that is capable of generating at least 2.5 to 3 kilowatts of energy. It is important to select a laser source having a laser energy density sufficient to provide the melting area and depth required. In the case of pulsed lasers, the pulse duration must also be considered to achieve melting of both the coating composition and the metal substrate below. According to a preferred embodiment, a continuous wave (cw) laser, such as a $CO_2$ laser equipped with an integrator lens may be used. The integrator lens serves to broaden the spot size of the laser beam in manner to allow the laser beam to cover a greater surface area of the metal substrate to be irradiated. Commercially available lasers suitable for laser welding applications equipped with integrator lenses attached to a mechanism for traversing the surface area of the metal substrate to be irradiated will allow an operator to irradiate paths up to 4 inches wide or greater at rates of up to 40 inches per minute or greater depending upon the particular commercial laser being used.

Silicate mineral composites used in the compositions of the present invention are characterized by an ability to create a viscous or gel-like medium when combined with a liquid component to support a dispersion of the metallic or semi-metallic compound. The silicate mineral composites should also comprise components such as $SiO_2$ useful in imparting desirable characteristics to a metal substrate since they will be incorporated as an alloying compound as well. In certain preferred embodiments the silicate mineral composite will be in the form of a powder and will have a mesh size on the order of 200 mesh or higher and which is capable of swelling or dispersing when mixed with the liquid. Certain silicate mineral composites within the scope of the present invention include those known as alumino-silicate minerals and clay-type silicate minerals including kaolinite, metahalloysite, pyrophyllite, montmorillonite, bentonite, beidellite, taylorite, halloysite, dickite, smectite and the like. Also within the scope of the present invention are certain organically modified clay-type silicate minerals like smectite which is marketed under the brand name BARAGEL. It is to be understood that certain powdered impurities like crystalline silica and quartz in various forms and the like may be present as a component of the clay-type silicate minerals. The silicate mineral composites are present in an amount between 0.1% to 20% by weight of the composition with a preferred range being between 0.5% to 10% with a more preferred range being 1% to 7%.

Liquid components according to the teaching of the present invention are characterized by their ability to form viscous or gel-like mediums sufficient to support a dispersion of a silicate mineral composite and a metallic or semi-metallic compound. In certain preferred embodiments, the liquids will be water insoluble or slightly water soluble and slightly volatile, i.e. low flash point, so that they can be removed from the coated surface of a metal substrate by heat relatively easily prior to irradiation. While the liquid component may be classified as being flammable, in a preferred embodiment, the liquid component is removed to the extent that no combustion or burning of the liquid component occurs upon laser irradiation. Liquid components according to the present invention include water insoluble or slightly water soluble hydrocarbon fluids such as relatively low volatility petroleum distillates or fractions and mineral spirits including mixtures of $C_5$ to $C_{18}$ hydrocarbons which are commonly used as solvents and diluents such as gasoline, naptha, ligroin, kerosene, Stoddard solvent and the like, whether in a straight chain, branched chain, saturated or unsaturated, modified or unmodified form. However, the hydrocarbon fluids will also include purer forms of $C_5$ to $C_{18}$ liquid hydrocarbons whether straight chain, branched chain, saturated or unsaturated, modified or unmodified. In general, the hydrocarbon fluids will be relatively low flash point viscous fluids. It is to be understood that other hydrocarbon fluids are within the scope of the present invention so long as they are capable of creating a gel like medium capable of supporting a dispersion of silicate mineral composites and metallic or semi-metallic compounds. Also included within the scope of the present invention are wood based distillates such as turpentine and camphor. Again, the liquid component need only be capable of forming a gel or viscous medium capable of supporting a dispersion of silicate mineral composites and metallic or semi-metallic compounds and be volatile enough to be easily evaporated from the coated surface of a metal substrate. The liquid component is present in an amount between 10% to 95% by weight of the composition with a preferred range being between 20% to 90% with a more preferred range being 25% to 75%.

Metallic or semi-metallic compounds, also termed alloying elements, within the scope of the present invention include transitions metals in elemental form or combinations of the transition metal elements with other metallic or semi-metallic elements from groups IIIA, IVA, VA, VIA such as B. Al, C, Si, N, S and Se or combinations of compounds from groups IIIA, IVA, VA, VIA themselves. In a preferred embodiment, the metallic or semi-metallic compounds, which are deemed to include ceramic powders as well, are present in the form of a powder preferably having a mesh size of 300 mesh or higher which is to be finely dispersed within the viscous or gel-like medium created by the silicate mineral composite and liquid component mixture. Accordingly, metallic or semi-metallic compounds of the present invention include Ti, Zr, Hf, V, Nb, Ta, Mo, W, Fe, Co, Ni, Cu, Ag, Au, Pt, Pd, Cr, Mn, Mg, Al, Si, $B_4C$, WC, TiC, SiC, TiN, BN, TiNi, $Cr_3C_2$, WB, $Mo_2C$, $Si_3N_4$, $Si_3N_4$, —SiC, $Al_2O_3$—SiC, $MoSi_2$, $Ti_5Si_3$, TiC—$TiB_2$ , $MoB_2$, TiC—TiN, $TiB_2$ and the like having similar physical and chemical characteristics. According to a preferred embodiment of the present invention, the metallic or semi-metallic compound will be a high melting point metal compound, i.e. one having a high thermal stability. The metallic or semi-metallic compounds of the present invention are present in an amount between 1% to 75% by weight of the composition with a preferred range being between 10% to 50% with a more preferred range being 25% to 40%.

It is to be understood that the relative amounts of the components of the compositions of the present invention may be varied to achieve a desired effect upon the base metal to which it is to be applied and in view of the differing weights of the various metallic or semi-metallic compounds which are useful in the practice of the present invention. Based upon the teachings presented herein, one will be able to prepare useful formulations having desired amounts of metallic or semi-metallic compounds dispersed therein which can then be used according to the methods of the present invention to incorporate the alloying element into a metal substrate.

The following examples are set forth as representative of the present invention. These examples are not to be construed as limiting the scope of the invention as these and other equivalent embodiments will be apparent in view of the present disclosure, figures, tables, and accompanying claims.

EXAMPLE I

Preparation of Compositions

Compositions of the present invention were prepared as follows. 8 grams of an organically modified bentonite clay material commercially available under the trademark BARAGEL was added to 120 ml of mineral spirits and stirred for approximately 15 minutes by conventional means to create a gel-like viscous fluid having the consistency of a paint. 40 grams of chromium powder (325 mesh) was then added and the mixture was stirred for an additional 10 minutes producing a dispersion of the chromium powder throughout the viscous fluid medium. This formulation had the following composition: about 6% smectite, about 66% mineral spirits (density 0.78 g/cm$^3$) and about 28% chromium powder. Larger batches (100 gallons or more) may be proportionately mixed simply by increasing the amount of each component of the composition.

EXAMPLE II

Additional Compositions

The procedure outlined in Example I can be used to produce additional compositions having differing percent compositions of silicate minerals such as kaolinite, metahalloysite, pyrophyllite, montmorillonite, bentonite, beidellite, taylorite, halloysite, dickite, smectite and the like having similar physical and chemical characteristics in combination with metallic or semi-metallic compounds such as Ti, Zr, Hf, V, Nb, Ta, Mo, W, Fe, Co, Ni, Cu, Ag, Au, Pt, Pd, Cr, Mn, Mg, Al, Si, $B_4C$, WC, TiC, SiC, TiN, BN, TiNi, $Cr_3C_2$, WB, $Mo_2C$, $Si_3N_4$, $Si_3N_4$, —SiC, $Al_2O_3$—SiC, $MoSi_2$, $Ti_5Si_3$, TiC—$TiB_2$, $MoB_2$, TiC—TiN, $TiB_2$ and the like having similar physical and chemical characteristics and liquid components including water insoluble or slightly water soluble hydrocarbon fluids such as relatively low volatility petroleum distillates or fractions and mineral spirits including mixtures of $C_5$ to $C_{18}$ hydrocarbons whether straight chain, branched chain, saturated or unsaturated, modified or unmodified as previously described, or wood based distillates.

EXAMPLE III

Application of the Composition to a Metal Substrate

The composition of Example I was applied to the previously dried surface of a carbon steel metal base substrate by means of a commercially available sprayer used to apply paint. The composition was applied in an thin even coat to effect visual coverage of a surface area of approximately 10 square inches per sample. It is to be understood that the thickness of the composition may be any desired thickness which can adhered to the metal substrate in an even coat. In addition, given the viscous nature of the composition and its ability to be sprayed in bulk, any desired surface area size may be coated. The composition was then dried using a low heat source, i.e. less than 100° F., to produce a solid layer of a mixture of the silicate mineral composite and the metallic compound which is uniformly adhered to and conforming with the surface of the metal substrate. After drying of the first layer, a subsequent layer may then be applied if desired.

EXAMPLE IV

Laser Irradiation of the Composition

The surface area of the applied composition of Example III was then irradiated with a standard commercially available high energy $CO_2$ continuous wavelength laser equipped with a integrator lens which was capable of being moved along the surface area of the applied composition on a suitable tracking device at a rate of approximately 18 to 40 linear inches per minute or greater to effectively melt both the composition and a depth of the metal substrate to allow the molten layers to intermix. The power output of the laser beam was between 2.5 to 3 kilowatts. Typical temperatures necessary to provide suitable melting are in the range of the melting point of the individual metallic components and the metal substrate, i.e. on the average of 500° C. to 2000° C., and can produce intermixing of alloying elements with metal substrates to a depth of as little as 0.2 to 0.3 millimeters based upon a single coating. It is to be understood that the depth of the melting depends upon the energy intensity of the laser source, the time of irradiation, the rate of movement of the laser source along the surface area of the applied composition, as well as, the composition and the metal substrate. At slower rates of irradiation or higher energy, the intermixing or dispersion will occur at greater depths into the metal substrate as desired. The metal substrate was then allowed to cool after which a cross section was obtained, polished, etched and then photographed as shown in FIG. 1. As FIG. 1 indicates, the composition was effectively intermixed with the carbon steel base as indicated by the lighter shaded surface portion of the metal substrate. In addition, components of the carbon steel base were found to be present at the surface of the metal substrate. The resulting alloy was 10% to 15% higher in chromium than was initially present in the carbon based steel. The resulting alloy may then be analyzed for physical and chemical characteristics according to well known methods such as scanning electron microscope techniques for determining percent composition of elements, ASTM method of salt spray testing, B117-85, for determining corrosion resistance and the use of a microhardness tester for determining the relative hardness of the unaltered metal substrate versus the alloyed portion of the metal substrate. In addition, residual composition can be readily removed from the surface of the metal substrate by using the liquid component which may then be recycled into a bulk batch of the composition.

It is to be understood that the embodiments of the present invention which have been described are merely illustrative of some of the applications of the principles of the invention. Numerous modifications may be made by those skilled in the art based upon the teachings presented herein without departing from the true spirit and scope of the invention.

What is claimed is:

1. A composition for incorporating alloying compounds into metal substrates comprising a viscous fluid dispersion of a powdered alumino-silicate or clay silicate mineral composite, a powdered metallic or semi-metallic compound or element and a water insoluble or slightly water soluble liquid component.

2. The composition of claim 1 wherein the alumino-silicate or clay silicate mineral composite is selected from the group consisting of kaolinite, metahalloysite, pyrophyllite, montmorillonite, bentonite, beidellite, taylorite, halloysite, dickite, and smectite.

3. The composition of claim 1 wherein the metallic or semi-metallic compound or element is selected from the group consisting of Ti, Zr, Hf, V, Nb, Ta, Mo, W, Fe, Co, Ni, Cu, Ag, Au, Pt, Pd, Cr, Mn, Mg, Al, Si, $B_4C$, WC, TiC, SiC, TiN, BN, TiNi, $Cr_3C_2$, WB, $Mo_2C$, $Si_3N_4$, $Si_3N_4$, —SiC, $Al_2O_3$—SiC, $MoSi_2$, $Ti_5Si_3$, TiC—$TiB_2$, $MoB_2$, TiC—TiN, and $TiB_2$.

4. The composition of claim 1 wherein the liquid component is a hydrocarbon fluid having a mixture of one or more $C_5$ to $C_{18}$ liquid hydrocarbons.

5. The composition of claim 4 wherein the hydrocarbon fluid is naptha or ligroin.

6. The composition of claim 1 wherein the alumino-silicate or clay silicate material composite is smectite.

7. The composition of claim 1 wherein the powdered alumino-silicate or clay silicate mineral composite is present in an amount between about 0.1% to about 20% by weight, the powdered metallic or semi-metallic compound or element is present in an amount between about 1% to about 75% by weight and liquid component is present in an amount between about 10% to about 95% by weight.

8. The composition of claim 7 wherein the powdered alumino-silicate or clay silicate mineral composite is present in an amount between about 0.5% to about 10% by weight, the powdered metallic or semi-metallic compound or element is present in an amount between about 25% to about 40% by weight and the liquid component is present in an amount between about 25% to about 75% by weight.

* * * * *